US010100826B2

(12) United States Patent
Casey

(10) Patent No.: US 10,100,826 B2
(45) Date of Patent: Oct. 16, 2018

(54) PAD PLUNGER

(71) Applicant: PLUNGER LIFT INNOVATIONS LLC, Huntsville, TX (US)

(72) Inventor: Clinton McShane Casey, Huntsville, TX (US)

(73) Assignee: Plunger Lift Innovations LLC, Huntsville, TX (US)

( * ) Notice: Subject to any disclaimer, the term of this patent is extended or adjusted under 35 U.S.C. 154(b) by 176 days.

(21) Appl. No.: 15/187,726

(22) Filed: Jun. 20, 2016

(65) Prior Publication Data

US 2017/0002634 A1 Jan. 5, 2017

Related U.S. Application Data

(60) Provisional application No. 62/186,884, filed on Jun. 30, 2015.

(51) Int. Cl.
*E21B 43/12* (2006.01)
*F04B 47/12* (2006.01)

(52) U.S. Cl.
CPC ..... *F04B 47/12* (2013.01); *E21B 43/121* (2013.01)

(58) Field of Classification Search
CPC ..... E21B 43/121; E21B 43/122; E21B 37/04; E21B 37/045; F04B 47/12
USPC ..... 166/68, 105; 15/104.05, 104.061, 104.18
See application file for complete search history.

(56) References Cited

U.S. PATENT DOCUMENTS

| | | | | |
|---|---|---|---|---|
| 4,798,246 | A * | 1/1989 | Best | B08B 9/0436 134/23 |
| 8,869,902 | B2 | 10/2014 | Smith et al. | |
| 9,033,038 | B2 * | 5/2015 | Hetz | E21B 47/00 166/250.17 |
| 9,121,269 | B2 | 9/2015 | Longfellow et al. | |

* cited by examiner

*Primary Examiner* — Kenneth L Thompson
(74) *Attorney, Agent, or Firm* — Winstead PC

(57) ABSTRACT

A plunger for a wellbore plunger lift system includes a piston having a top end and a bottom end, and a pad having an inner surface that is positioned adjacent to the piston. In some embodiments the pad is moveable from a retracted position to an extended position where a bottom end of the pad is positioned a greater distance than a top end from a central axis of the piston. The piston may include a communication passage extending through the piston from a position above the pad to a position between the piston and the inner surface of the pad. The pad plunger may be a bypass or non-bypass plunger.

23 Claims, 5 Drawing Sheets

PAD PLUNGER

CROSS-REFERENCES TO RELATED APPLICATIONS

This application claims the benefit under 35 U.S.C. § 119(e) of U.S. Provisional Patent Application No. 62/186,884, filed Jun. 30, 2015, which is incorporated herein by reference in its entirety as if fully set forth herein.

BACKGROUND

This section provides background information to facilitate a better understanding of the various aspects of the disclosure. It should be understood that the statements in this section of this document are to be read in this light, and not as admissions of prior art.

Hydrocarbon producing gas wells generally produce liquids in addition to the flowing gas stream. These fluids, gas and liquids, are conducted to the surface by a string of production tubing that communicates the below ground formation to a piping system at the surface. Removal of the liquid fraction of the fluid column is mandatory for maintaining the unrestricted production of gas from the production zone formation. Frequently, a beam pump unit is employed for this task. However, beam pumping units are expensive and suffer from high maintenance costs.

In the field of plunger lift, a plunger acts as an unattached piston within the length of the production tubing for the purpose of lifting liquids from an active, gaseous hydrocarbon-bearing formation. In the life cycle of a plunger lift system, the plunger travels first downwardly to the bottom region of the tubing string adjacent to the formation then upwardly within the tubing string multiple times within the course of the day. The use of a plunger within the tubing conduit of a gas well will enable the upward flow of light-density gas to push toward the surface those heavier liquids within the tubing string.

Plunger movement is controlled by one or more flow control valves located between the upper end of this tubing conduit and the surface piping arrangement. Whenever a flow control valve at the surface is closed, the flow of fluids from the near-surface wellbore is terminated. At this point and by the force of gravity, the plunger within the tubing falls to the bottom of the production string within the wellbore where it typically encounters a shock-spring arrangement approximate the end of the tubing string. As the plunger falls, it encounters gas and liquid within the tubing. Being lighter relative to the plunger, these fluids are displaced around the plunger to a position above the falling plunger device. This migration is made possible by the undersized dimension of the piston-like plunger. In bypass plungers, the gas and liquid migrate up through an open central passageway within the plunger during descent Later, once flow is reestablished at the surface, a plunger will begin its return to its uppermost range at the upper end of the tubing string. A plunger is forced to the surface by the up-flowing gas stream below it. As the plunger migrates upwardly, it pushes to the surface any liquid above the plunger and ahead of the gas column that is expanding from below the plunger.

There exist three plunger styles, the solid, one-piece plunger (non-bypass), the bypass plunger with an internal valve element and the two-piece bypass plunger. The effectiveness of each of these plungers is a function of its sealing element. The sealing elements of the several plunger iterations within the art vary in design and efficiency. There exist two common and one less common external sealing mechanism: the spiral groove design; the pad sealing element; and the less common elastomeric sealing elements. Any of these three sealing means listed can be used in conjunction with any of the three plunger styles.

A two-piece plunger will not return toward the surface until it first comes into contact with and joins to its external valve element, generally a spherical ball. Classified as one-piece plungers, both the dart plunger and the captured rod plunger have an internal valve element that is shifted into the closed position as these bypass plungers reach the bottom spring stop arrangement adjacent the end of the tubing. Once this internal valve is shifted to a closed position, these bypass style plungers will return to the surface, carried by the up-flowing gas stream.

The common spiral plunger is a solid one-piece design without an internal passageway. The common spiral plunger typically has concentric grooves arrayed along its length. It fits within the tubing string somewhat loosely per the requirements specified within the industry. The industry standards ensure that the purposefully undersized plunger will not become lodged within the tubing string. The pad style plunger and its sealing element fit more snugly within the tubing string and constitute a superior seal as compared to the spiral plunger. Because the sealing elements of the pad plunger are biased outwardly by springs, the larger pad plunger will not become wedged within the tubing.

SUMMARY

A plunger for a wellbore plunger lift system includes a piston having a top end and a bottom end, and a pad having an inner surface that is positioned adjacent to the piston, the pad moveable from a retracted position to an extended position to contact the tubular string in which it is deployed. In some embodiments, when the pad is deployed to the extended position a bottom end of the pad is positioned a greater distance than a top end is from a central axis of the piston. In some embodiments the piston includes a communication passage extending through the piston from a position above the pad to a position between the piston and the inner surface of the pad. The pad plunger may be a bypass or non-bypass plunger.

A method in accordance to an embodiment includes utilizing a plunger in a wellbore, the plunger including a piston having a top end and a bottom end, a pad having an inner surface positioned adjacent to the piston, the pad moveable from a retracted position to an extended position wherein a bottom end of the pad is positioned a greater distance than a top end from a central axis of the piston, and the piston having a communication passage extending through the piston from a position above the pad to a position between the piston and the inner surface of the pad; descending the piston in a tubing with the pads retracted toward the piston allowing fluid from below the piston to migrate between the tubing and an outer surface of the piston to above the piston; and ascending the piston in the tubing with the pad in the extended position.

A method in accordance to an embodiment includes utilizing a pad plunger in a wellbore, the plunger including a piston having a top end and a bottom end, a pad having an inner surface positioned adjacent to the piston, the pad moveable from a retracted position to an extended position, and the piston having a communication passage extending through the piston from a position above the pad to a position between the piston and the inner surface of the pad; descending the piston in a tubing with the pads retracted toward the piston allowing fluid from below the piston to migrate between the tubing and an outer surface of the piston to above the piston; and ascending the piston in the tubing with the pad in the extended position.

This summary is provided to introduce a selection of concepts that are further described below in the detailed description. This summary is not intended to identify key or essential features of the claimed subject matter, nor is it intended to be used as an aid in limiting the scope of claimed subject matter.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
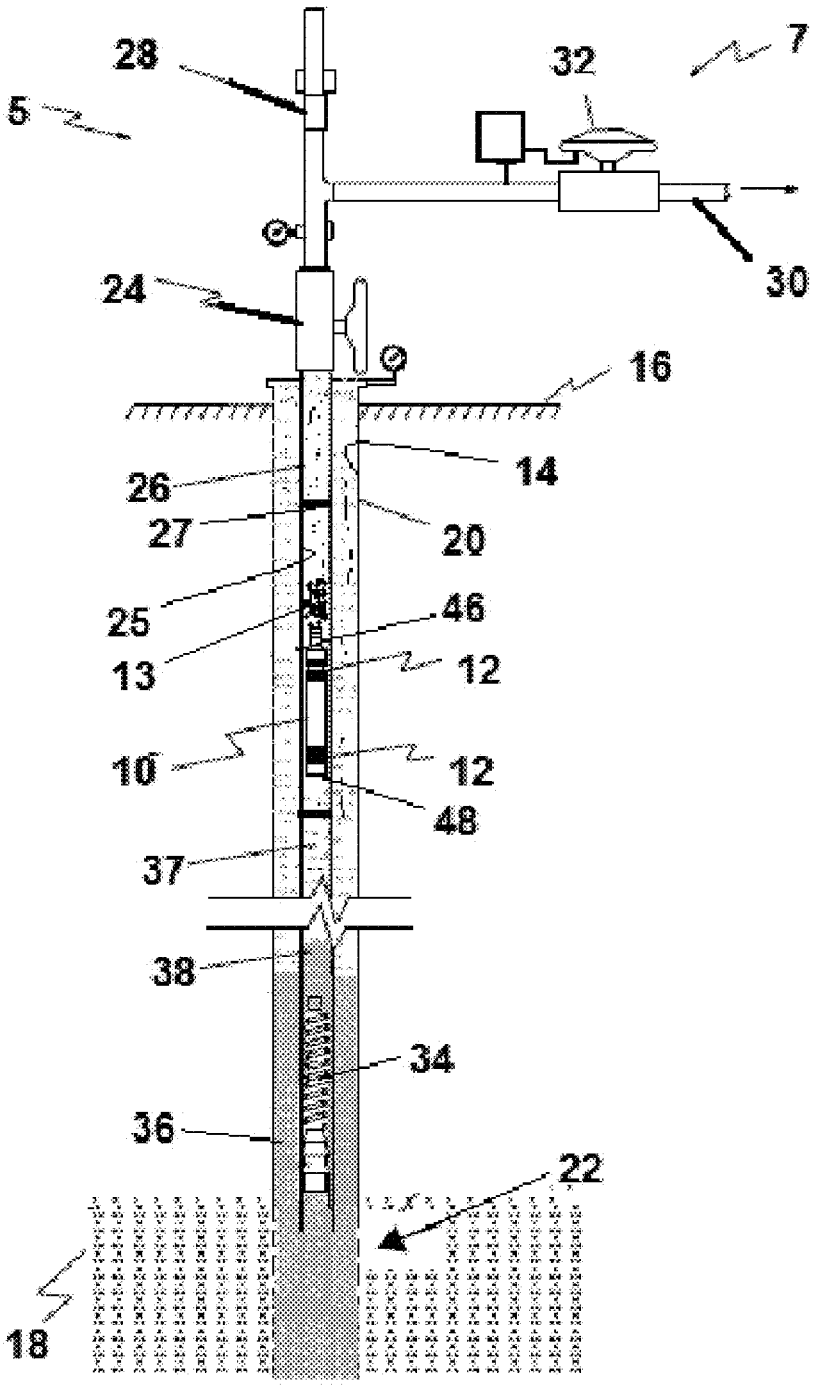
FIG. 1 illustrates a plunger lift system incorporating a pad plunger in accordance with one or more aspects of the disclosure.

It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed.

As used herein, the terms connect, connection, connected, in connection with, and connecting may be used to mean in direct connection with or in connection with via one or more elements. Similarly, the terms couple, coupling, coupled, coupled together, and coupled with may be used to mean directly coupled together or coupled together via one or more elements. Terms such as up, down, top and bottom and other like terms indicating relative positions to a given point or element are may be utilized to more clearly describe some elements. Commonly, these terms relate to a reference point such as the surface from which drilling operations are initiated.

FIG. 1 illustrates a well system 5 incorporating a plunger lift production system 7 which utilizes a pad plunger, generally denoted by the numeral 10, in accordance with one or more aspects of the disclosure. Pad plunger 10 includes one or more sets of pads 12 extending circumferentially about the pad plunger 10 (e.g., piston, mandrel, body). Pad plunger 10 may be a bypass plunger having a central fluid passage or a non-bypass plunger.

The well system 5 includes a wellbore 14 extending from a surface 16 of the earth to a producing formation 18. Wellbore 14 may be lined with a casing 20 including perforations 22 proximate the producing formation. The surface end of the casing is closed at the surface by a wellhead generally denoted by the numeral 24. A tubing string 26 having an interior surface 25 extends down the casing and is in connection at the surface with a lubricator 28, also referred to as a catcher, and a production line (conduit) 30. Tubing string 26 is commonly formed by the threaded connection of adjacent pipe sections at joints 27. One or more control valves 32 are connected to the tubing string. A spring 34 is positioned at the lower end of the tubing string to stop the downward travel of the pad plunger 10.

Formation fluid 36 enters the casing through the perforations and into the tubing for example through a standing valve and separates into a liquid portion 36 (with entrained gas) and a gas portion 37 as indicated by the gas-liquid interface 38. The free travelling pad plunger is lifted from the bottom of the well to the surface when the lifting gas energy below the pad plunger is greater than the liquid load and gas pressure above the pad plunger. In a plunger lift system operation, the well is shut-in by closing a flow control valve for a period of time during which sufficient formation pressure is developed within the casing to move the pad plunger 10 and the liquid slug 13 that is above the plunger upward to the surface when the flow control valve is opened. The pad 12 or pads of the pad plunger are operative to move radially outward and into contact with the inside surface 25 of the tubing string 26. As further described with reference to FIGS. 2-7 the pad 12 may utilize only a portion of the outer surface 58 to make sealing contact with the tubing.

Figure 2:
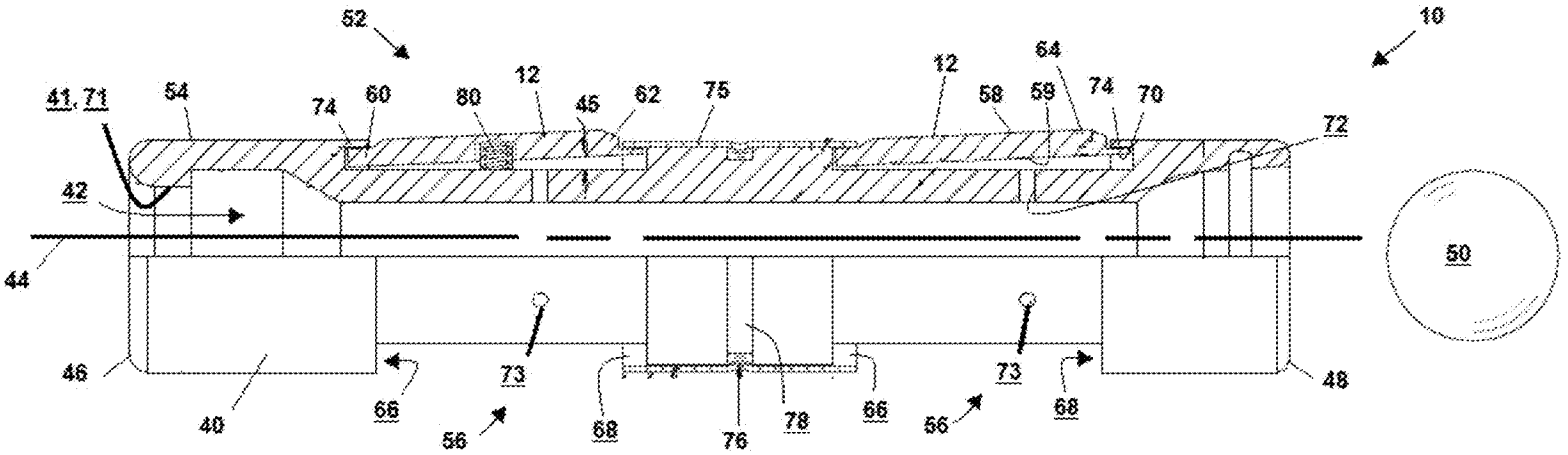
FIG. 2 is a partial sectional view of a bypass pad plunger with an external valve element in accordance with one or more aspects of the disclosure.

FIG. 2 illustrates an example of a pad plunger 10 in accordance with one or more aspects of the disclosure. In this example, pad plunger 10 is a bypass plunger in which the plunger body, piston or mandrel 40 has a central bypass passage 42 extending longitudinally, for example along axis 44, from the top end 46 to the bottom end 48 of the mandrel 40 to allow fluid to pass during descent of the pad plunger in the tubing. The top end 46 may include a fishneck profile, female or male, for fishing the mandrel from the wellbore if necessary. A female fishneck profile, i.e., internal profile, may produce a refined concentration of pressure differential during the descent of the pad plunger in the tubing biasing the pads 12 toward the mandrel and away from the tubing wall. The bypass pad plunger 10 includes a valve element 50 for closing the bypass passage 42 during ascent in the tubing. In FIG. 2 the pad plunger is a two-part plunger in which the valve element 50 is an independent element that separates from the piston (mandrel) portion during the descent and is received in the second end 48, closing bottom port 43, during ascent.

Mandrel 40 includes a middle section 52 (e.g., seal section) between the first and second ends on which a pad 12 is positioned circumferentially about the mandrel. Each pad 12 may be constructed of two or more sections to extend circumferentially about the mandrel. The mandrel 40 has an outer surface 54 defining a nominal outside diameter of the mandrel. The middle section 52 includes a pad pocket 56, in which the pad 12 is located, having a reduced diameter relative to the outer surface 54. The depth of the pad pocket is defined relative to the nominal diameter such that the when the pad 12 is in the retracted position the outer surface 58 of the pad may be withdrawn to a position proximate to or inside of the nominal diameter to reduce friction against the tubing during descent. The discrepancies in the inside diameter of the tubing string require that the pads 12 be allowed to collapse to a known minimum diameter to ensure that the pad plunger can descend within the tubing. In FIG. 2 the mandrel includes two sets of pads 12 which are spaced longitudinally from one another. The pad plunger may include only one or more than two sets of pads.

Pads 12 may be constructed of one or more materials suitable for the well conditions and that are satisfactorily wear resistant without destroying the conduit in which it slides. According to one or more aspects, pads 12 may comprise a wear-resistant coating, case hardening, and/or may be made from carbide or other materials to increase longevity. Some tubing installations may suffer from excessive deviation such that a shorter plunger featuring a single row of pads is preferred. Alternately, a triple pad set design may increase the useful wear life of the plunger because, with multiple rows of pads, the uppermost set can be expected to seal effectively. After this uppermost pad set wears excessively, the second highest pad set is positioned to generate the lowest pressure drop across the pad surface, enhancing the sealing effect for that set of pads.

Figure 3:
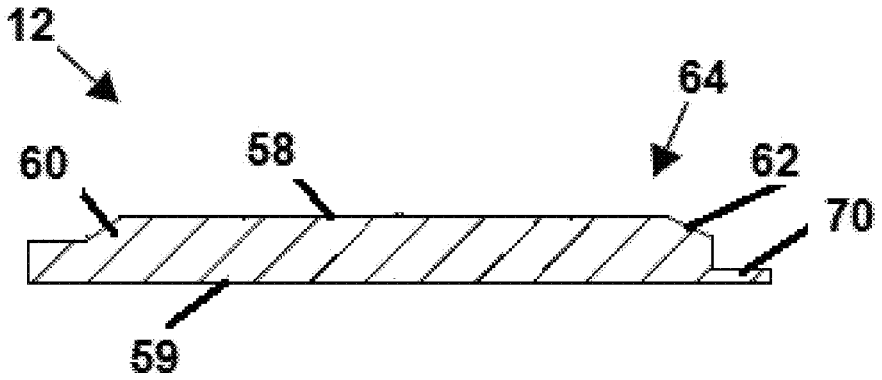
FIGS. 3 and 4 illustrate sectional views of pads of a pad plunger in accordance with one or more aspects of the disclosure.
Figure 4:
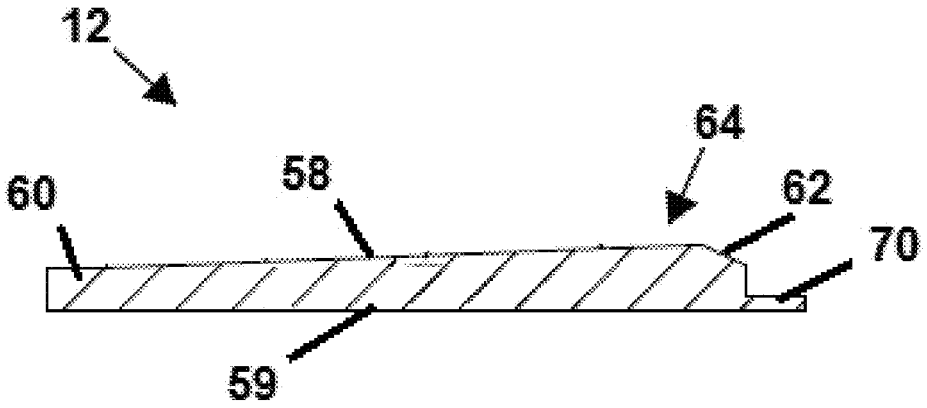

With additional reference in particular to FIGS. 3 and 4, the pad 12 extends longitudinally from a top end 60 to a bottom end 62. The pads have an axial, longitudinal length sufficient to avoid catching in the gaps that may exist at the joints between tubing sections. The pads 12 are radially movable between an innermost position and an outermost position (see, FIG. 2) so that a portion of the pad contacts the inner wall of the tubing string to substantially seal between the pad plunger and the tubing string. Reducing the surface area of the contact surface 64 may reduce the effect of pad-float caused by upwardly moving gas acting against the pad. The radial or lateral movement of the pad outward from the mandrel can be provided by various biasing means including, but not limited to, one or more of a creating a low pressure zone outside of the pad 12, providing pressurized fluid to the bottom or inner surface 59 of the pad, or a mechanical biasing mechanism 80 (e.g., spring) illustrated in FIG. 2. In accordance with embodiments of the pad plunger 10, physical outward biasing mechanisms 80 are absent from the pad plunger. In accordance to some aspects the disclosure, see for example FIGS. 2 and 5-7, the tubing contact or sealing surface 64 is formed along a lower portion of the outer surface 58 of the pad as opposed to pads, e.g. FIG. 8, in which substantially the full longitudinal length of the pad contacts the tubing and provides the sealing section.

The plunger and pad depicted in FIGS. 2 and 5-7 are constructed to act as an airfoil whereby a low pressure zone may be created (e.g., Venturi effect) exterior of the pad 12 during ascent to draw the pad radially outward and toward the tubing in response to upward moving gas in the tubing string. In accordance to embodiments of the disclosure, the airfoil characteristics are formed whereby in the extended outermost position the bottom end 62 of the pad 12 creates a larger diameter than the top end 60 of the pad 12. The relative radial position of the outer surface of the top end of the pad and the bottom end of the pad can be achieved in the manner of connecting the pad 12 with the mandrel and/or in the configuration (shape) of the pad 12. For example, in FIG. 3 the cross-sectional thickness (between the outer surface 58 and inner surface 59) of the pad 12 is substantially uniform across the longitudinal length of the pad and the airfoil configuration may be provided in the manner of radial movement relative to the plunger piston as described with reference to FIG. 2. In FIG. 4, the cross-sectional thickness of the pad tapers from lesser at the top end 60 to a greater diameter at the bottom end 62 and the airfoil configuration may be achieved merely by moving the pad lateral to the longitudinal axis.

An example of connecting a pad 12 to a mandrel 40 to form an airfoil configuration is described in particular with reference to FIGS. 2-4. The bottom end 62 is radially moveable outward from the longitudinal axis 44 a greater distance than the radial movement of the top end 60. In accordance to an embodiment, as illustrated for example in FIG. 2, the pad recess 56 includes an upper trap 66 in which the top end 60 of the pad 12 is located and a bottom trap 68 in which a reduced thickness section or tab 70 at the bottom end 62 of the pad is positioned. This type of connection of the pad to the mandrel restricts the movement of the top end 60 of the pad relative to the mandrel 40 and allows the bottom end 62 of the pad to float (i.e., move radially) relative to the mandrel for example in response to the upward movement of the gas past the pad 12. In FIG. 2 the pad 12 is shown extending radially outward relative to the longitudinal axis 44 at an angle 45. The desired angle 45 may be determined for example based on the internal tubing diameter, the pad plunger diameter, and the speed of upward gas flow. A non-limiting angle 45 is about five degrees.

FIG. 2 illustrates the use of a circumferential ring 75 to connect the pads 12 to the mandrel 40. For example, one of the top and bottom trap 66, 68 is formed by shoulder 74 of the mandrel extending over the pad recess 56. The other one of the top and bottom trap 66, 68 is formed by the pad recess 56 and a shoulder portion of the circumferential ring 75 that extends over the pad recess. In accordance with an embodiment, the ring 75 is a compression ring that has an oversized diameter to clear the minimum diameter of the plunger and pads for placement. Once in place overlapping an end of the pad recess and the disposed pad end, i.e. the terminal top end or terminal bottom end, and the adjacent outer nominal diameter surface 54, the compression ring is formed into position for example with a swaging tool. The compression ring 75 may be dimpled 76 into a groove 78 in the mandrel.

As discussed above the biasing of the pad 12 outward from the mandrel 40 may be created by the airfoil shape of the pads relative to the mandrel (e.g., FIGS. 2 and 5-7) creating a low pressure zone between the outer surface 58 of the pad and the tubing string 26. An additional pad biasing force can be created by directing pressurized wellbore fluid (gas or liquid) to the inner surface 59 of the pads 12 through a communication passage 72 extending from an opening above the pads to an under the inner surface of the pad. For example, when the pad plunger 10 is moving upward within the tubing string 26 there is pressurized gas below the pad plunger 10 moving the plunger upward to satisfy the pressure differential that exists between the upper and lower ends of the tubing string. Another source of pressurized fluid is the column or slug 13 of wellbore liquid which is being lifted and produced by the pad plunger 10 and against which the plunger exerts an upward force.

The wellbore fluid may be directed from an area above the pad plunger 10 through the bypass passage 42 and through a communication passage 72 to the inner surface 59 of the pad 12 via an outlet port 73 located in the pad recess 56. A communication passage 72 may be provided between the pressurized area below the pad plunger and the inner surface. In some embodiments, a communication passage may be provided behind one set of pads and not behind a second or third set of pads.

Providing a fluid communication passage 72 between an area above the pad plunger 10 and the inner surface 59 of the pad 12 may also be effective at promoting a low pressure zone at the inner surface during the descent portion of the plunger cycle. The falling movement of the pad plunger produces a high pressure zone immediately below the pad plunger and a lower pressure zone above the pad plunger. When the fluid communication passage 72 is established between the area above the pad plunger 10 and the inner surface, the lower pressure zone above the pad plunger 10 is transmitted to the inner surface 59 and acts to retract the pad 12 toward the mandrel 40 and away from the tubing thereby reducing the drag of the pads against the tubing and reducing the overall wear rate of the pads. This effect is facilitated by the absence of physical biasing mechanisms (i.e., springs 80) that bias the pads. This functionality may exist in bypass pad plungers 10 and non-bypass pad plungers 10.

Figure 5:
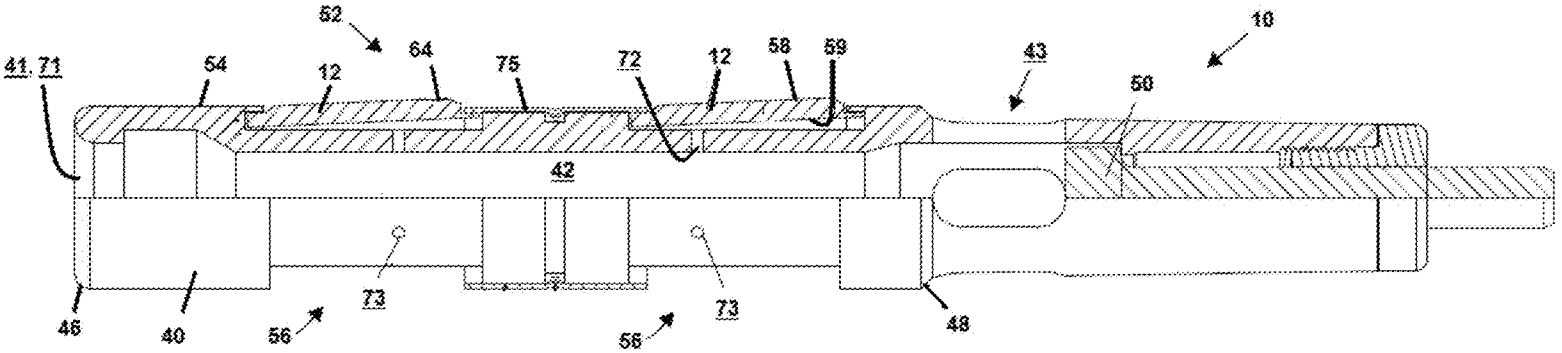
FIG. 5 is a partial sectional view of a bypass pad plunger with an internal valve element in accordance with one or more aspects of the disclosure.

FIG. 5 illustrates a one-piece bypass pad plunger 10 in accordance with one or more aspects of the disclosure. Bypass passage 42 extends from a top opening or port 41 located above the pads 12 to a bottom port 43 located below the pads 12. The fluid communication passage 72 extends from the opening 71, which is the same as port 41 in FIGS. 2 and 5, above the pads 12 through and through the side of the piston, e.g., port 73, under the inner surface 59 of the pad. In this example, the valve member 50 is a stem or rod that is axially movable to open and close a bottom port 43 to the bypass passage 42. The first end 46 of the illustrated pad plunger includes an internal fishneck profile and in some embodiments includes a male fishneck profile. The pad plunger 10 illustrated in FIG. 5 also utilizes an airfoil configuration.

Figure 6:
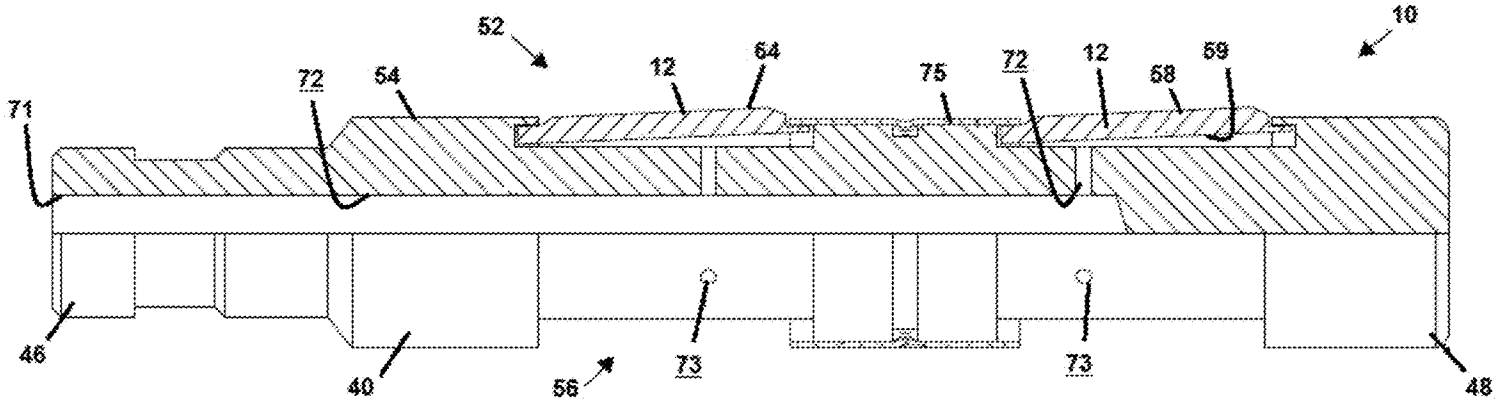
FIGS. 6 and 7 are partial sectional views of non-bypass pad plungers in accordance with one or more aspects of the disclosure.
Figure 7:
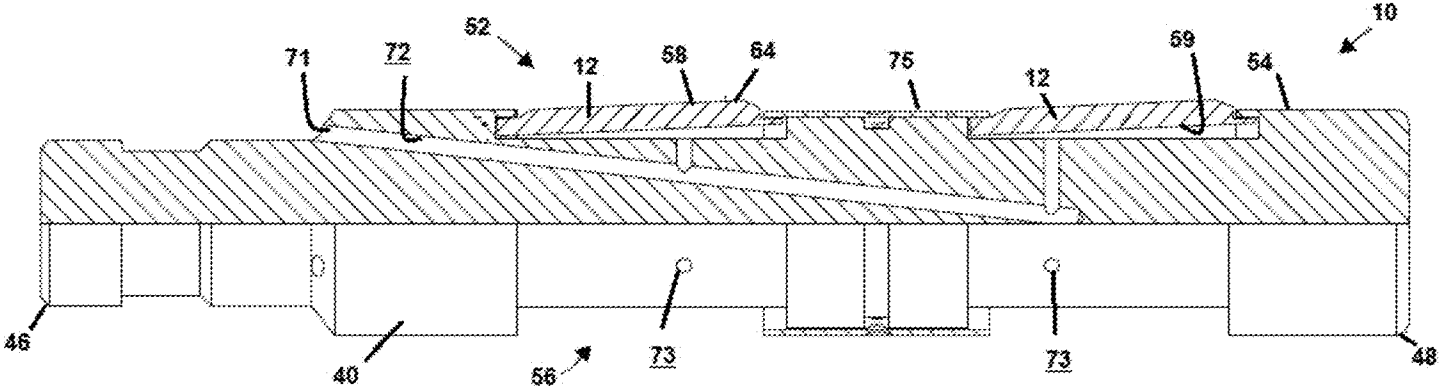

FIGS. 6 and 7 illustrate examples of non-bypass pad plungers 10 utilizing an airfoil configuration. In these non-limiting examples, the top end 46 has an external male fishneck profile, which may be replaced with an internal fishneck profile. The examples in FIGS. 6 and 7 also include a fluid communication passage 72 that extends from an inlet port 71 located above the pads 12 in the depicted example to an outlet port 73 located in the pad recess 56 at the inner surface 59 of the pad 12. The pad plungers 10 illustrated in FIGS. 2 5 and 7 may utilize the airfoil configuration and not include a communication passage 72 extending from a port above or below the pads to a port under the pads.

Figure 8:
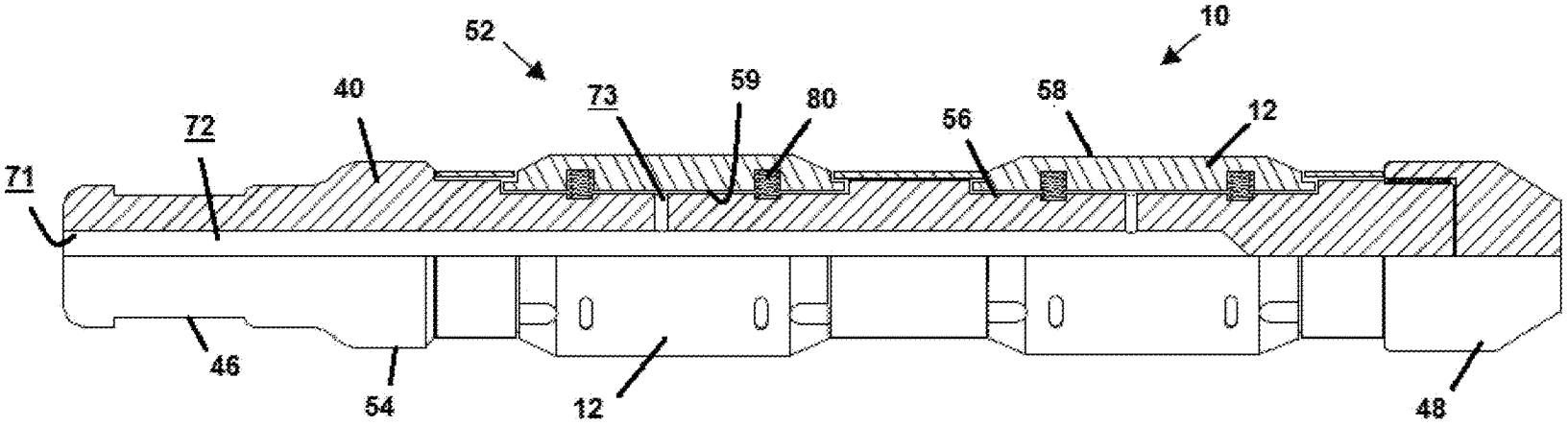
FIG. 8 is a partial section view of a non-bypass plunger having a fluid communication passage extending from above the pads to a position between the piston and the inner surface of the pad in accordance with one or more aspects of the disclosure.

FIG. 8 illustrates a pad plunger incorporating a fluid communication passage 72 and that does not incorporate an airfoil configuration. Pad plunger 10 includes a mandrel or piston 40 that has a seal or middle section between the first end 46 and the second end 48. Circumferential pads 12 are positioned in a pad recess 56 formed in the middle section 52 and having a reduced diameter relative to a nominal diameter or outer surface 54 of the mandrel. The pads 12 are laterally movable relative to the piston 40. Biasing of the pads 12 laterally outward from the mandrel or piston 40 during the ascent in the tubing string is performed, at least in part, by fluid passing from above the plunger piston entering opening 71, passing through communication passage 72 and exiting port 73 to impinge the inner surface 59 of the pads. The example in FIG. 8 also includes physical biasing elements 80 to urge pads 12 outward. In some embodiments, the physical biasing elements 80 may be excluded. In this example the outer surface 58 of the pads may remain substantially parallel to the longitudinal axis of the piston when extended whereby substantially the length of the outer pad surface contacts the tubing wall.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure and that they may make various changes, substitutions, and alterations herein without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A plunger for a wellbore plunger lift system, the plunger comprising:

a piston having a top end and a bottom end; and a pad having an inner surface positioned adjacent to the piston and an outer surface, the pad moveable from a retracted position to an extended position, wherein the outer surface of a lower end of the pad is positioned a greater distance from a central axis of the piston than the outer surface of an upper end of the pad is positioned from the central axis.

2. The plunger of claim 1, wherein the plunger is a bypass plunger comprising a bypass passage extending from the top end of the piston to the bottom end of the piston.

3. The plunger of claim 1, wherein the piston does not have a bypass passage.

4. The plunger of claim 1, further comprising a communication passage extending through the piston from a position above the pad to a position between the piston and the inner surface of the pad.

5. The plunger of claim 1, further comprising a physical biasing member disposed between the piston and the inner surface to bias the pad outward from the piston.

6. The plunger of claim 1, wherein a physical biasing member is not disposed between the piston and the inner surface to bias the pad outward from the piston.

7. The plunger of claim 1, wherein a thickness of the pad between the outer surface and the inner surface increases from the upper end to the lower end of the pad.

8. The plunger of claim 1, wherein the piston comprises an exterior surface and a pad recess having a reduced diameter relative to the exterior surface, wherein the pad is disposed in the pad recess.

9. The plunger of claim 1, wherein:

the piston comprises an exterior surface and a pad recess having a reduced diameter relative to the exterior surface, wherein the pad is disposed in the pad recess; and a portion of the upper end of the pad is positioned in a first trap and a portion of the bottom end of the pad is positioned in a second trap, wherein radial movement of the upper end of the pad is restricted and the lower end of the pad is free to float radially in the second trap.

10. The plunger of claim 9, wherein one of the first trap and the second trap is formed between the pad recess and a circumferential ring.

11. The plunger of claim 9, wherein the plunger is a bypass plunger comprising a bypass passage extending from the top end of the piston to the bottom end of the piston; and the piston further comprises a communication passage extending through the piston from a position above the pad to a position between the piston and the inner surface of the pad.

12. The plunger of claim 11, wherein a physical biasing member is not disposed between the piston and the inner surface to bias the pad outward from the piston.

13. The plunger of claim 9, further comprising a communication passage extending through the piston from a position above the pad to a position between the piston and the inner surface of the pad; and wherein the piston does not have a bypass passage.

14. The plunger of claim 1, wherein the plunger is a bypass plunger comprising a bypass passage extending from the top end of the piston to the bottom end of the piston; and the piston further comprises a communication passage extending through the piston from a position above the pad to a position between the piston and the inner surface of the pad.

15. The plunger of claim 1, further comprising a communication passage extending through the piston from a position above the pad to a position between the piston and the inner surface of the pad; and wherein the piston does not have a bypass passage.

16. A method, comprising:

utilizing a plunger in a wellbore, the plunger comprising a piston having a top end and a bottom end, a pad having an inner surface positioned adjacent to the piston and an outer surface, the pad moveable from a retracted position to an extended position wherein the outer surface of a lower end of the pad is positioned a greater distance from a central axis of the piston than the outer surface of a lower end of the pad is positioned from the central axis;

descending the piston in a tubing with the pads retracted toward the piston allowing fluid from below the piston to migrate between the tubing and an exterior surface of the piston to above the piston; and ascending the piston in the tubing with the pad in the extended position whereby only a contact surface located on the outer surface of the lower end of the pad is in sealing contact with the tubing.

17. The method of claim 16, wherein the piston comprises a bypass passage extending from the top end of the piston to the bottom end of the piston, wherein the bypass passage is open during the descending and the bypass passage is closed by a valve member during the ascending.

18. The method of claim 16, wherein the piston does not have a bypass passage.

19. The method of claim 16, wherein:

the piston comprises an exterior surface and a pad recess having a reduced diameter relative to the exterior surface, wherein the pad is disposed in the pad recess; and a portion of the upper end of the pad is positioned in a first trap and a portion of the bottom end of the pad is positioned in a second trap, wherein radial movement of the upper end of the pad is restricted and the lower end of the pad is free to float radially in the second trap.

20. The method of claim 16, wherein a thickness of the pad between the outer surface and the inner surface increases from the upper end to the lower end of the pad.

21. A pad plunger, comprising:

a piston having a top end and a bottom end;

a pad having an inner surface positioned adjacent the piston and an outer surface, the pad laterally moveable relative to the piston, wherein a physical biasing member is not disposed between the piston and the inner surface of the pad to bias the pad outward from the piston; and a communication passage extending through the piston from a position above the pad to a position between the piston and the inner surface of the pad.

22. The pad plunger of claim 21, comprising a physical biasing member disposed between the piston and the inner surface of the pad to bias the pad outward from the piston.

23. A method, comprising:

utilizing a pad plunger in a wellbore, the plunger comprising a piston having a top end and a bottom end, a pad having an inner surface positioned adjacent to the piston, and the piston comprising a communication passage extending through the piston from a position above the pad to a position between the piston and the inner surface of the pad;

descending the piston in a tubing with the pads retracted toward the piston allowing fluid from below the piston to migrate between the tubing and an exterior surface of the piston to above the piston; and ascending the piston in the tubing with the pad in the extended position.

* * * * *